US006160493A

United States Patent [19]

Smith

[11] Patent Number: 6,160,493

[45] Date of Patent: Dec. 12, 2000

[54] RADIO WARNING SYSTEM FOR HAZARD AVOIDANCE

[75] Inventor: Eugene T. Smith, Alexandria, Va.

[73] Assignee: Estech Corporation, Annandale, Va.

[21] Appl. No.: 08/960,347

[22] Filed: Oct. 29, 1997

[51] Int. Cl.[7] ..... G08G 1/00

[52] U.S. Cl. ..... 340/902; 340/903

[58] Field of Search ..... 340/902, 903, 340/901, 988, 989, 905

[56] References Cited

U.S. PATENT DOCUMENTS

| | | | |
|---|---|---|---|
| 3,772,692 | 11/1973 | Braddon | 343/6 R |
| 3,854,119 | 12/1974 | Friedman et al. | 340/33 |
| 3,876,940 | 4/1975 | Wickord et al. | 325/64 |
| 3,997,868 | 12/1976 | Ribnick et al. | 340/902 |
| 4,238,778 | 12/1980 | Ohsumi | 340/903 |
| 4,403,208 | 9/1983 | Hodgson et al. | 340/902 |
| 4,623,966 | 11/1986 | O'Sullivan | 364/461 |
| 5,068,654 | 11/1991 | Husher | 340/903 |
| 5,111,210 | 5/1992 | Morse | 342/455 |
| 5,153,836 | 10/1992 | Fraughton et al. | 364/461 |
| 5,249,157 | 9/1993 | Taylor | 340/903 |
| 5,303,259 | 4/1994 | Loveall | 340/902 X |
| 5,307,060 | 4/1994 | Prevulsky et al. | 340/902 |
| 5,307,074 | 4/1994 | Janex | 342/41 |
| 5,314,037 | 5/1994 | Shaw et al. | 180/169 |
| 5,471,214 | 11/1995 | Faibish et al. | 342/70 |
| 5,495,243 | 2/1996 | McKenna | 340/902 |
| 5,506,590 | 4/1996 | Minter | 342/462 |
| 5,554,982 | 9/1996 | Shirkey et al. | 340/903 |
| 5,572,201 | 11/1996 | Graham et al. | 340/902 |
| 5,620,155 | 4/1997 | Michalek | 246/121 |
| 5,635,923 | 6/1997 | Steele et al. | 340/905 |
| 5,636,123 | 6/1997 | Rich et al. | 364/461 |
| 5,808,560 | 9/1998 | Mulanax | 340/902 |
| 5,825,304 | 10/1998 | Marin | 340/903 |
| 5,917,430 | 6/1999 | Greneker, III et al. | 340/905 |
| 5,926,112 | 7/1999 | Hartzell | 340/902 |

*Primary Examiner*—Jeffery A. Hofsass
*Assistant Examiner*—Sihong Huang
*Attorney, Agent, or Firm*—Burns, Doane, Swecker & Mathis, L.L.P.

[57] ABSTRACT

A low-cost and reliable radio warning system that alerts system users of potential hazardous conditions is disclosed. The system makes use of a transmitter and at least one receiver. The transmitter generates and transmits a radio warning signal that carries a digital data sequence that includes information concerning a particular potential hazardous condition from which the transmission was initiated, such as an approaching ambulance, fire truck, bus, train, or the like. Other information, such as GPS coordinates, may also be included. Through the use of digital encoding techniques, the system's susceptibility to false alarms or "false triggers" is minimized. The radio warning signal is transmitted in burst transmissions and may use a number of signaling techniques, including spread spectrum transmission, which increases system reliability and performance even in the presence of interference or multipath distortion. System users are equipped with a receiver that receives the radio warning signal and interprets the digital data and information carried by the warning signal. The receiver alerts the system user who has received the radio warning signal of the potential hazardous condition through the use of an audible, visual or tactile alarm. Based on the simplicity of its design, the receiver is intended to be small enough to be a portable, hand held-device, or installed or mounted in a user's motor vehicle so that persons carrying the receiver and motor vehicle operators alike can be alerted of potentially hazardous conditions by receiving a radio warning signal of the present invention.

39 Claims, 9 Drawing Sheets

FIXED FREQUENCY TRANSMITTER SYSTEM DIAGRAM

RADIO WARNING SYSTEM FOR HAZARD AVOIDANCE

BACKGROUND

The present invention relates to systems for avoidance of hazards and collisions. More particularly, the present invention relates to a radio warning system that alerts vehicle operators and other persons carrying system receivers of hazardous conditions so that such conditions can be avoided.

Today, persons traveling from one location to another are being confronted with hazardous conditions with increasing frequency. Roads and highways have, for example, become more populated in recent years, presenting unsuspecting persons, such as pedestrians and operators of motor vehicles, with increased threats to their safety from approaching emergency vehicles, buses, trains, or the like. In many cases, such persons may not be aware of the impending threat, which creates a dangerous situation.

For instance, the passenger compartments of most automobiles are designed and manufactured such that outside noises cannot be heard when the windows of the compartment are closed. Operators and passengers of an automobile may, therefore, have difficulty hearing sirens, horns or whistles from other approaching emergency vehicles, buses or trains. Thus, when an ambulance or fire truck is responding to an emergency call, an unsuspecting motorist may never see or hear the rapidly approaching emergency vehicle and, consequently, may be unable to steer clear of the emergency vehicle's path. This creates a potential hazardous situation for the operators and passengers of the motor vehicle and emergency vehicle alike.

Similarly, a pedestrian or other person who may be traveling by foot, wheelchair, or bicycle, may also be presented with hazardous conditions, particularly where that person is physically-challenged from loss of hearing or sight. In such instances, these persons may likewise be unaware of an approaching emergency vehicle, bus or train simply because they cannot hear its siren, horn or whistle, or cannot otherwise see it as it approaches. Under these circumstances, such persons may be unable to stay out of harm's way, creating yet another hazardous and dangerous condition.

Prior art systems have, to a limited extent, recognized the need for warning automobile operators and others of approaching vehicles for purposes of collision avoidance. However, these systems have significant limitations and disadvantages. For example, radio frequency (RF) energy has been used, in prior art systems, to alert the occupants of one vehicle to the presence of another vehicle. In such systems, RF signals were transmitted from one vehicle and detected by a unsuspecting second vehicle. Upon detection, a warning signal was generated in the second vehicle. The warning signal, however, was transmitted over the radio or through independent audio and visual components, as shown in U.S. Pat. No. 3,854,119, issued to Friedman et al., and U.S. Pat. No. 3,876,940, issued to Wickford et al. The Friedman patent describes the use of amplitude modulated signals to operate switching means for activating devices such as audio speakers, light emitting diodes, panel displays or neon lights in relation to the amplitude of the received signals. The Friedman patent, however, requires constant transmission of amplitude modulated signals which do not perform well in the presence of interference or multipath distortion. The Wickford patent discloses a warning device utilizing radio transmission on an assigned frequency having a transmitter in the emergency vehicle and a receiver in the regular vehicle. The Wickford patent makes use of a receiver that mutes the broadcast reception on the vehicles radio or otherwise turns the vehicles radio on, and applies the warning signal through the vehicle's radio system. Such a system has not, however, become accepted in the marketplace because it is expensive, susceptible to "false triggers" (i.e., false alarms), and would require additional end-user licenses from the Federal Communications Commission (FCC) before the system could be operated in the general consumer broadcast (e.g., AM or FM) bands.

For these reasons, other prior art systems have abandoned RF signaling as a method for transmitting warning signals and, instead, have elected to use systems that require line of sight (LOS) communications and other communication systems that use receivers having a small beamwidth such as U.S. Pat. No. 5,314,037, issued to Shaw et al. and U.S. Pat. No. 5,495,243, issued to McKennan. However, these prior art systems have also not received acceptance in the marketplace, primarily because they are not effective unless the system's receiver is within the LOS or beamwidth of the system's transmitter.

SUMMARY

The present invention overcomes the limitations and disadvantages of existing prior art systems and addresses an unsolved need for a low-cost and reliable radio warning system. It is, therefore, an object of the present invention to provide a radio warning system for hazard avoidance that is inexpensive and attractive for commercial manufacture and use. It is further an object of the present invention to provide such a system that is reliable and that is not likely to experience false alarms or "false triggers." It is yet another object of the present invention to provide such a system that does not require an additional end-user license from the FCC, beyond the standard FCC approval process governed by 47 C.F.R. § 15.1 et seq.

These and other objects are achieved by the present invention through use of a transmitter and at least one receiver. The transmitter generates and transmits a radio warning signal carrying a digital data sequence that includes information concerning a potential hazardous condition. The digital data sequence is sufficiently unique to minimize susceptibility of false triggers.

The transmitter includes a user interface for initiating generation of the radio warning signal. The transmitter uses a microprocessor to generate the digital data sequence and also includes signal processing components that modulate the digital data sequence onto a carrier waveform to produce the radio warning signal, which may be received by system users who are within the effective range of the system. The transmitter is intended to be sufficiently powerful to transmit warning signals to any receiver within a range of approximately 2500 feet, but without exceeding the power limits set by the FCC in 47 C.F.R. § 15.1 et seq.

Unlike prior art systems, the transmitter is also designed to provide burst transmissions which reduces the average RF power and thereby enables the system to transmit with higher peak power. This increases system reliability and allows the system to be implemented using a simple design configuration and low-cost components. The digitally-coded radio warning signal generated by the transmitter will include a trigger code and an alarm type identifier, among other information, that is specific to a potential hazardous condition. The digitally-coded signal may include other information on, for example, the type of potential hazard that initiated the transmission, such as an ambulance, fire truck, bus, train, or the like. Thus, where the transmitter is installed on an emergency vehicle, the digitally coded signal will alert a system user within the system's effective range of the emergency vehicle as it approaches the user's location. The system user will have a receiver that receives the radio warning signal and interprets the digital data and information carried by the warning signal.

Based on the simplicity of its design, the receiver is intended to be small enough to be a portable, hand held-device, or installed or mounted in a user's motor vehicle. In this way, persons carrying the receiver and motor vehicle operators alike can be alerted of potentially hazardous conditions by receiving a radio warning signal of the present invention.

The receiver's components will include signal processing components for demodulating and processing the received radio warning signal. The receiver will also include a digital data recovery device that extracts the digital data or information concerning the potential hazardous condition. In addition, the receiver includes a user interface that includes at least one indicator, and preferably more, which may alert a system user who has received the radio warning signal of the potential hazardous condition through the use of an audible, visual or other alarm. In a more sophisticated application of the system, the transmitter may include Global Positioning Satellite (GPS) coordinate information in the digital data or information that is carried by the radio warning system. Thus, for those receivers that are, for example, installed on a motor vehicle having a GPS mapping display and are interfaced with that display, those receivers can extract the GPS coordinates of the transmitter location from the digital data sequence and display the transmitter's location on the GPS mapping display to provide a further indication of an approaching potential hazardous condition.

The present invention may be implemented using a number of signaling techniques. A fixed frequency system implementation is an economical design choice that is likewise attractive for commercial manufacture. Alternatively, the invention may be implemented using spread spectrum communication techniques, such as frequency hopping. Although it is more expensive than the fixed frequency approach, a spread spectrum system implementation offers significant performance improvement. For instance, through the use of frequency hopping, the present invention will be minimally affected, if at all, by interference or multipath distortion. Thus, even though a spread spectrum may be relatively more expensive than the fixed frequency approach, spread spectrum remains an attractive design choice for commercial manufacture and use in view of its performance advantages.

BRIEF DESCRIPTION OF THE DRAWINGS

The objects and advantages of the present invention will be understood by reading the following detailed description in conjunction with the drawings in which.

DETAILED DESCRIPTION

Figure 1A:
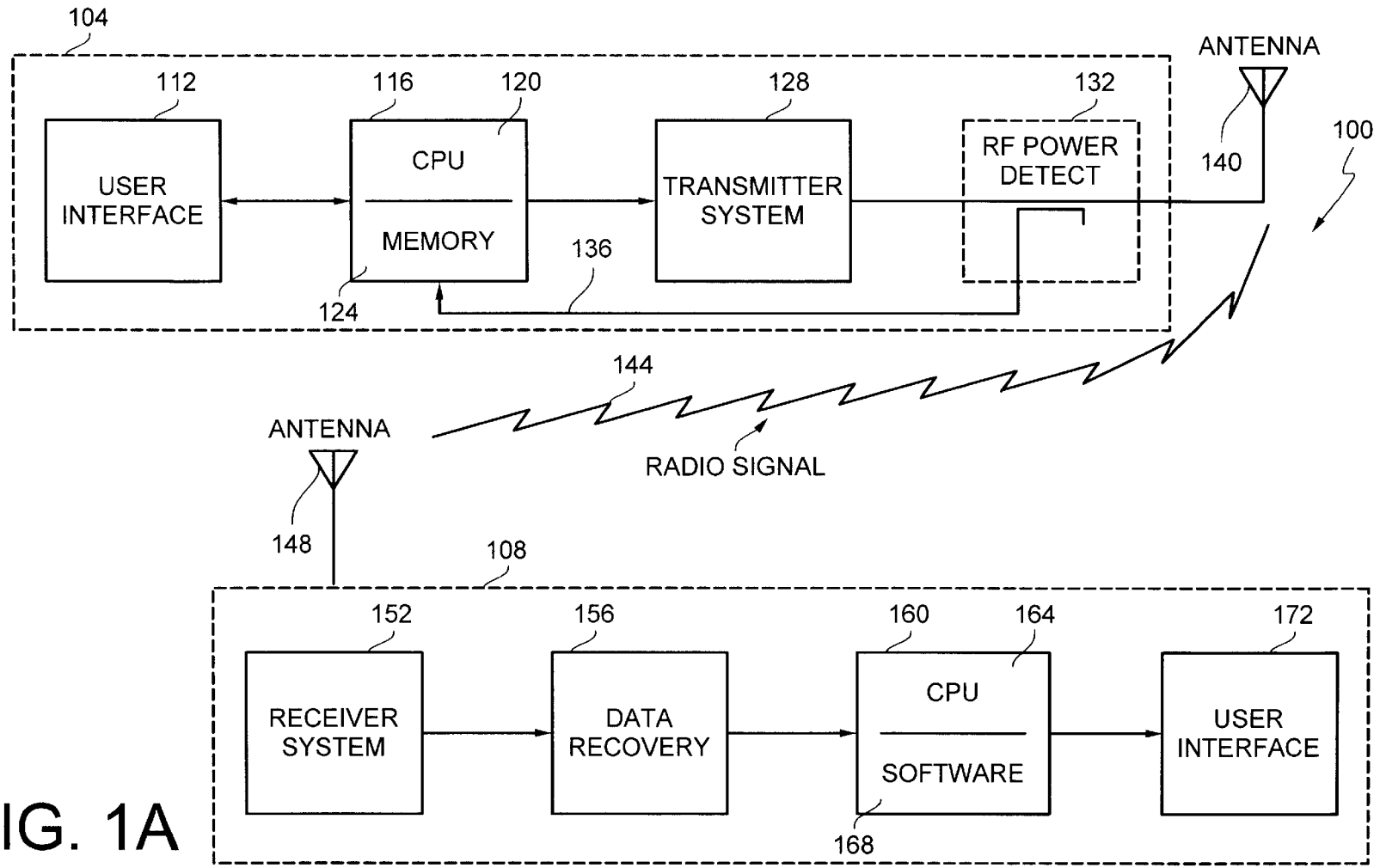
FIG. 1A illustrates a block diagram for the radio warning system of the present invention.

FIG. 1A illustrates the radio warning system of the present invention. As shown in FIG. 1A, the system 100 includes a transmitter 104 and a receiver 108. The transmitter 104 is designed to provide radio frequency (RF) transmissions that may be received by each receiver 108 operating within the effective range of the system 100. The system 100 is intended to operate over a range of approximately 2500 feet, although this may vary depending on the power of the transmitter 104. It is preferred that the transmitter 104 be designed to provide burst transmissions to reduce the average RF power of the system and thereby avoiding the need to provide continuous transmission of RF signals. By operating as a burst transmitter over a relatively short effective range, the transmitter 104 may be implemented using low-cost components that are effective in signaling receivers 108 operating throughout the system 100, which creates an attractive design for commercial manufacture.

Referring to FIG 1A, the transmitter 104 includes a user interface 112, a microcontroller 116, a transmitter system 128, and an optional RF power detection system 132. These components enable the transmitter 104 to generate signals for RF transmission over the air through an antenna 140. The antenna 140 is intended to be an omni-directional antenna or any other antenna capable of transmitting in any direction. The user interface 112 initiates the transmission of signals to various receivers 108 in the system 100. The user interface 112 may include manual or automatic activation switches which trigger the transmission of a given warning signal and status indicators that provide an indication of proper transmitter operation. Once an activation switch is triggered, the microcontroller 116 will generate a digital data sequence and instruct the transmitter system 128 to modulate this sequence into an appropriate signal. The transmitter system 128 will, in accordance with control from the microcontroller 116, process this digitally-coded signal for transmission.

The digitally-coded signal is a signal encoded with the digital data sequence that includes a trigger code for an alarm and an alarm type identifier, among other information that is specific to a potential hazardous condition. The present invention makes use of digital encoding of information to provide high security and to minimize the system's susceptibility against false alarms or "false triggers." Such false triggers may be caused from random noise which erroneously appear to various receivers in the system as a proper warning signal transmission. However, by using codes of sufficient length, the present invention minimizes its susceptibility to false triggers. For example, if the system uses a digital code length of 16 bits, the probability of a false trigger is 1 in $2^{16}$, or 1 in 65,536. This equates to one false trigger every 35 seconds.

The likelihood of a false trigger, however, can be significantly reduced by increasing the digital code length to 32 bits. Using a code length of 32 bits, the resulting false trigger rate is improved to approximately once every 636 hours. Such a code length would minimize the likelihood of a false trigger to merely once a year, assuming the system is used for only a few hours a day. Other longer digital code lengths may likewise be used at the expense of increased transmission time, but which further minimize the susceptibility of false triggers in the system. It is, however, preferred that a 32-bit digital code be used as a reasonable code length. Through the use of such digital encoding, the present invention minimizes the likelihood of false triggers more efficiently than non-digital (i.e., analog) coding systems, which would require the use of narrow bandwidth IF filters and other precision components to achieve the same system security and reliability of the present invention.

In addition to trigger codes and alarm type identifiers, the digitally-coded signal may also include information that is specific to a potential hazardous condition such as, for example, information on the type of potential hazard that initiated the transmission, such as an ambulance, fire truck, bus, train, or the like. Thus, where the transmitter 104 has been installed on an emergency vehicle, the digitally-coded signal will, at a minimum, identify the source of the transmission as an emergency vehicle. Other information may likewise be included. For example, a particular emergency vehicle may, in addition to being identified by type (e.g., ambulance, fire truck, etc.), be also identified by other codes in the signal, such as vehicle number, town code, emergency type code, and any other information which would help identify the type of vehicle or potential hazard. The receiver 108 will receive this transmission and recognize the transmitted codes as emanating from an approaching emergency vehicle.

These codes may also be used to identify sources of false warning signal transmissions, other than false triggers. For example, unlike a false trigger which may be caused by random noise, false warning signal transmissions may occur where a particular activation switch is left "on" after the mobile host carrying a transmitter is parked. In this case, receivers operating within the effective range of the transmitter would receive a "false" radio warning signal, even though there is no danger. However, through the use of unique code numbers specific to particular transmitters, sources of such false warning signal transmissions can be readily identified by a receiver operating within the system. Users of the receiver could then notify the operator of the transmitter of the problem. Alternatively, the transmitter may include a timeout feature that disables the activation switch after several seconds so that such false transmissions do not continue.

The information concerning the source of the potential hazard or emergency vehicle that initiated the warning signal transmission is stored in the microcontroller's memory 124. This memory will store all of the information concerning that potential hazard or emergency vehicle, which may be inserted into the digitally-coded signal for transmission to various receivers 108 operating within the system 100. The microcontroller's memory 124 will preferably be nonvolatile and flexible enough to accommodate any hazard-specific information, which may be inserted in the digitally coded signal. This information could be included in the digitally-coded signal so that any receiver 108 which receives a warning signal may interpret the hazard-specific information carried by the signal and activate an appropriate alarm indicator for the user of that receiver 108.

The transmitter may also include GPS coordinate information in the digital data or information that is carried by the radio warning system. In this way, receivers that are installed on a motor vehicle having a GPS mapping display and are interfaced with that display can extract the GPS coordinates of the transmitter location from the digital data sequence and display the transmitter's location on the GPS mapping display to provide a further indication of an approaching potential hazardous condition.

Each receiver 108 will have an antenna 148, a receiver system 152, a data recovery system 156, a microcontroller 160 and a user interface 172. The antenna 148 will receive the RF transmissions from a transmitter 104 operating within the system's effective range. The antenna 148 is intended to be an omni-directional antenna or any other antenna capable of receiving transmissions from all directions. The receiver system 152 includes receiver signal processing components that will process those transmissions so that data or information carried by the signal can be interpreted and further processed by the receiver 108. The receiver system 152 will convert the digitally-coded signal into information that can be processed by other components of the receiver 108. The data recovery system 156 will extract the digital data sequence or information that was carried by the transmission and will input this extracted data to the microcontroller 160. The microcontroller will include a microprocessor 164 and software 168, which will process the data or information that was carried by the signal. The microcontroller 160 will then, in response to this processing, send an appropriate control signal to a user interface 172 to activate a corresponding status or alarm indicator (not shown) on the user interface 172. The indicator may be an audible or visual alarm that will alert the user of the type of hazard that may be imminent. Other indicators, such as a tactile (i.e., vibrating) alarm, may also be used.

Figure 1B:
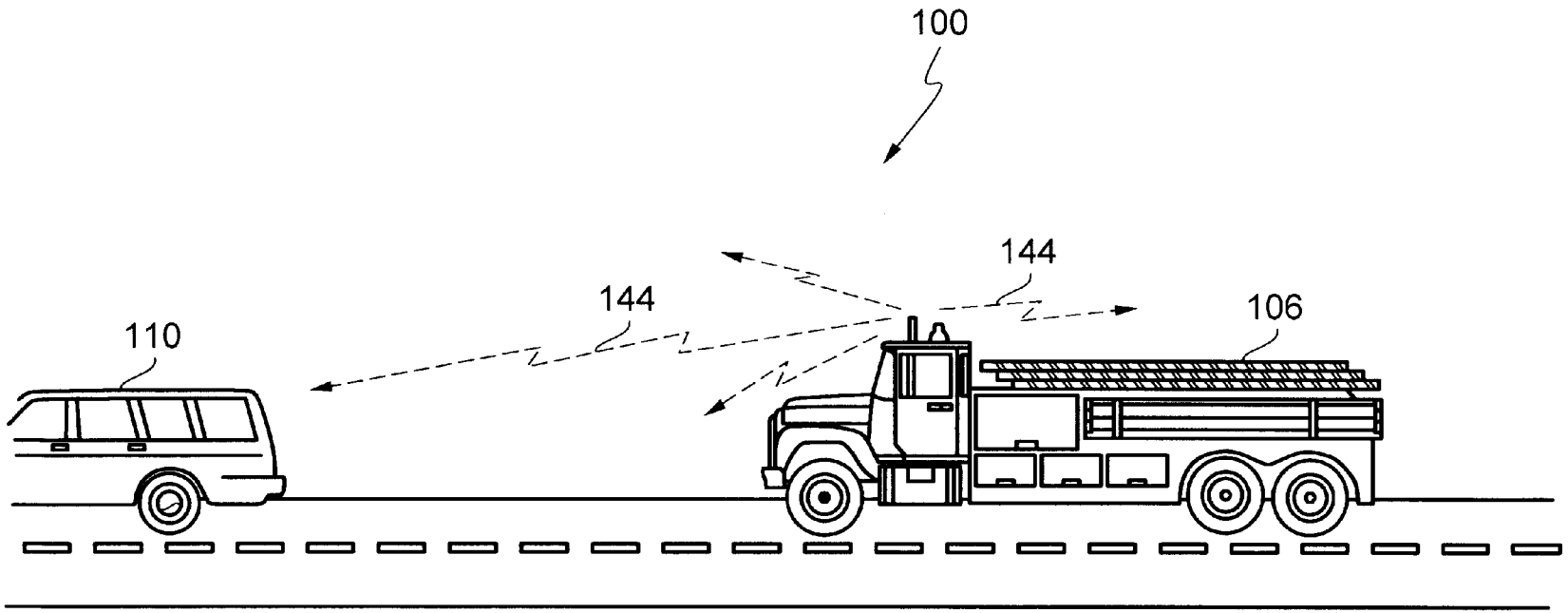
FIG. 1B illustrates an implementation of the radio warning system of the present invention on an emergency vehicle.

FIG. 1B illustrates one implementation of the present invention. As shown in the figure, the radio warning system transmitter 104 is installed on an emergency vehicle (i.e., a fire truck) 106. As the emergency vehicle 106 approaches another motor vehicle 110, a radio warning signal 144 is transmitted from the emergency vehicle 106 to any receivers that might be operating within the effective range of the system 100. In this example, the motor vehicle 110 is within this range and will receive the radio warning signal 144 transmitted from the emergency vehicle 106.

Figure 1C:
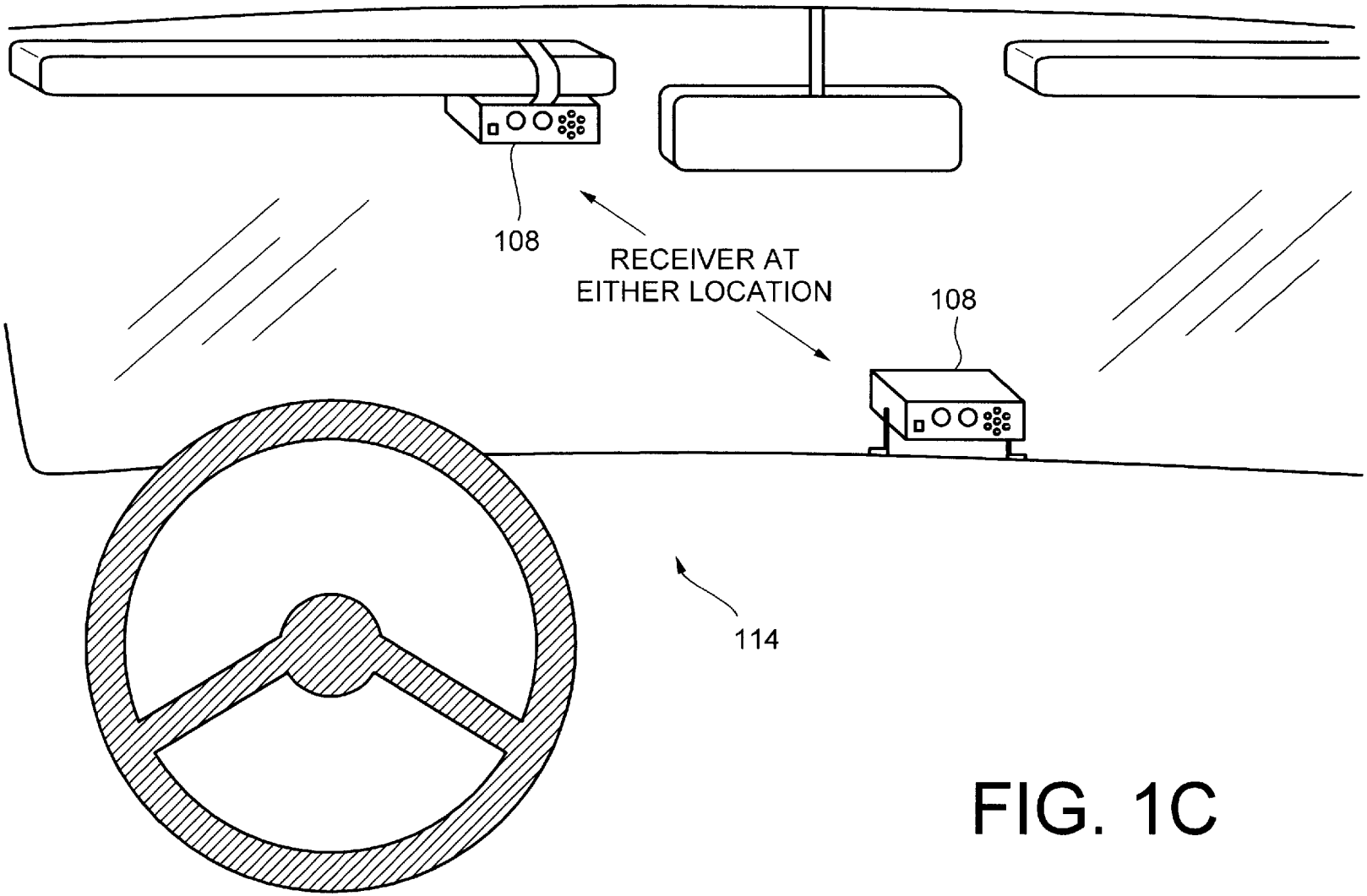
FIG. 1C illustrates an example of the placement of a receiver operating within the radio warning system of the present invention.

FIG. 1C illustrates one embodiment of a receiver 108 installed within the passenger compartment 114 of a motor vehicle. As shown in FIG. 1C, the receiver 108 may be installed in a number of locations, including as a clip-on device to a sunvisor, as a dashboard-mounted device, or at any other location convenient to the operator of the motor vehicle. The receiver 108 may include optional interfaces, which would allow the receiver to interface, for example, with a GPS mapping display installed in the motor vehicle so that GPS coordinates of the transmitter location could be received and displayed.

The receiver 108 is preferably designed to be a lightweight and portable device. Thus, the receiver 108 is not limited to any specific type of installation within a passenger compartment of a motor vehicle and, instead, may be a portable hand-held device, similar to a pager. In this way, pedestrians and motor vehicle operators who leave their vehicle may wish to take the portable receiver 108 with them so that they may be apprised of any hazardous conditions or emergency situations as they occur.

The system 100 may be implemented through a number of transmitter and receiver configurations and various signaling techniques. In a preferred embodiment, the system 100 may operate as a fixed, single frequency system. Because it requires relatively few components, the fixed frequency system design is the most economical and practical design for mass production of the system. Although a fixed frequency system may be prone to multipath distortion and possible interference or jamming of signal transmissions, these conditions are not likely to significantly affect operation of the system 100. Multipath distortion occurs when a transmitted signal arrives at a receiver by two or more paths of different delays. This can pose a problem in radio systems since the transmitted signal is received not only by a direct path between the transmitting and receiving antennas, but also by reflections from objects between the two antennas, such as hills, buildings, and other objects along the transmission path. This effect may create errors in signal reception.

This problem, however, can be overcome in the present invention by using "burst" transmissions, which merely require the transmitter to repeatedly transmit the same signal. Although a number of burst rates may be used, it is preferred that the signal transmission be repeated once every several milliseconds. However, a rate in the range between 1 millisecond and 1 second is suitable for this purpose. In addition, because the transmitter 104 of the present invention will typically be implemented on a mobile host, such as an emergency vehicle, bus, train, or other transport carrier capable of collision with a system user, the transmitter will be moving relative to the receiver. This minimizes the likelihood that the burst transmissions will be continuously impaired by interference or jamming. Thus, using burst transmissions from a transmitter in a moving or otherwise mobile host, the present invention will not experience any deleterious effects for more than a fraction of a second at a time and can, therefore, make use of any transmission technique that accommodates repetitive burst transmissions.

Figure 2:
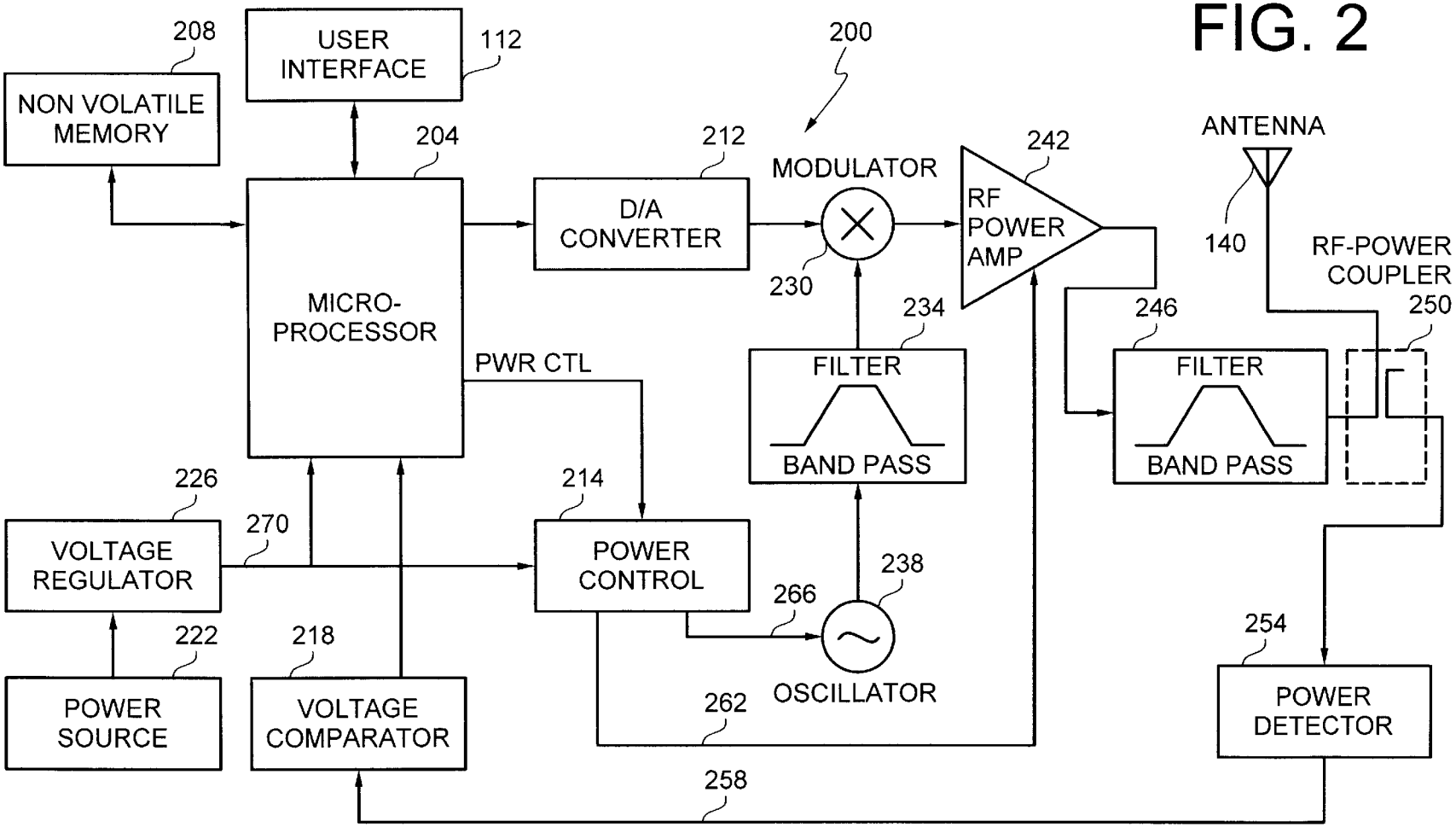
FIG. 2 is a block diagram illustrating a configuration for a fixed frequency transmitter system suitable for use in the radio warning system of the present invention.

FIG. 2 illustrates a fixed frequency transmitter system for the present invention. As shown in FIG. 2, the fixed frequency transmitter system 200 includes a user interface 112 for initiating warning signal transmissions. The user interface 112 includes one or more activation switches (not shown) that begin the transmission process, and one or more status indicators (not shown) to show that the transmitter system 104 is working properly. The activation switches initiate the transmission of data packets from the transmitter 200, in the form of a digitally-coded signal, to receivers in the system. Such activation switches may be manual and automatic. Manual activation switches will require an operator at the transmitter location to manually activate a particular switch to initiate warning signal transmissions. Automatic activation switches can be triggered without direct operator input. For example, an automatic activation switch may be triggered in an emergency vehicle when the siren is activated. In such instances, when the operator of the emergency vehicle switches on the vehicle siren or other warning device, that device will activate the user interface 112 and initiate warning signal transmission. Automatic activation switches may, therefore, be electrically connected to other devices, such as a siren or other warning signal device on an emergency vehicle, bus, train, or the like, such that the operator of that vehicle will not need to likewise provide any input to the radio warning system. The activation switches may also include a timeout feature that disables warning signal transmission after several seconds once the transmitter host becomes stationary so as to avoid false warning signal transmissions.

The fixed frequency transmitter system 200 of the present invention is intended to be microprocessor-controlled. The microprocessor 204 is designed as a fully integrated microcontroller that includes built-in RAM, ROM, firmware and any digital functions needed to transmit digital data packets and read and control the user interface 112. Several commercially available microcontrollers may be used for this purpose. For example, the MicroChip PIC16C61 or PIC16C84 microcontrollers are readily-available, low-cost and relatively small microcontrollers suitable for this design. Other microcontrollers that do not include in-circuit programming may likewise be used.

The fixed frequency transmitter system 200 includes non-volatile memory 208, which is used by the microprocessor 204 to store unique identification information concerning the potential hazardous condition at which that transmitter 200 is located. For example, where the transmitter 200 is included on an emergency vehicle, school bus, train, construction vehicle, mail or package delivery vehicle, or other transport carrier capable of collision, this identification information can include codes or data on the type of vehicle, the vehicle number, geographic or other city code, emergency type code, as well as any other information or data regarding the specific type of hazard or vehicle carrying the transmitter 200, as described above. The non-volatile memory 208 is intended to store such hazard-specific data and information in instances where the transmitter 200 experiences power failure. Other data or information concerning the transmitter, such as GPS coordinates, may be provided from an external device to the microprocessor 204 through the user interface 112. In this way, the transmitter 200 may incorporate GPS coordinates into the radio warning signal.

In operation, the microprocessor 204 will access the non-volatile memory 208 once a transmission sequence is activated by the user interface 112. The microprocessor 204 will read the appropriate digital data from the non-volatile memory 208 or from an external device connected to the user interface 112. The microprocessor 204 will generate a corresponding digital data sequence and subsequently pass this sequence to the D/A convertor 212. The D/A convertor generates an appropriate waveform that may be further processed by a modulator 230 within the fixed frequency transmitter system 200, in preparing a particular warning signal for RF transmission. The D/A convertor 212 can make use of waveform tables that are digitally stored in ROM and may be input to the D/A convertor 212 at the time of transmission. Use of the D/A convertor 212 is a convenient and economical design choice since low pass filtering of the transmitted data can be accomplished entirely through software. Accordingly, other design choices may be used which produce the same effect in preparing the warning signal for transmission and which are well known in the art. By using the D/A convertor 212, however, the fixed frequency transmitter 200 makes use of a narrow bandwidth that does not require additional hardware filters and thereby reduces the cost of the design.

Once the digital data sequence is converted to an analog waveform by the D/A convertor 212, the modulator 230 places the resultant signal onto a carrier signal for RF transmission. The modulator 230 may be any commercially available modulator suitable for low-power, RF transmissions. Typically, the modulator 230 is a three port device that inputs a raw carrier signal on one port and outputs a signal on another port with amplitude proportionate the input voltage of its third port. It is preferred that the fixed frequency transmitter 200 use a modulator 230 that uses an on/off keyed (OOK) digital modulation technique. This technique, which is also known as amplitude shift keying (ASK), is selected to maintain a low-cost design. Other digital modulation techniques, such as FSK, BPSK, QPSK or QAM, may likewise be used at increased expense and complexity. Although OOK-modulated signals at a fixed frequency may not perform very well in the presence of continuous interference or jamming, this signaling technique is nevertheless appropriate for the present design, which is intended to transmit signals over close distances (i.e., 2500 feet) and use burst transmissions. As noted above, this technique improves system performance and, at the same time, overcomes other deleterious effects, such as multipath signal distortion, particularly where the transmission originates from a mobile host.

The carrier signal upon which the digital data signal is mapped by the modular to 230 is generated by the oscillator 238. The oscillator 238 provides a frequency reference in generating the carrier signal. Although a number of oscillator types can be used for purposes of the present invention, a crystal oscillator can be used to perform the desired functions of the oscillator 238. A crystal oscillator, however, is typically best suited for lower frequency (i.e., <300 MHZ) operations. As a consequence, although a crystal oscillator is cost efficient, it is driven to saturation at frequencies greater than 300 MHZ, generating relatively strong distortion harmonics. For this reason, a band-pass filter 234 should be used in conjunction with a crystal oscillator. Any band-pass filter that can filter out the unwanted harmonics generated by the crystal oscillator may be used for the filter 234 shown in FIG. 2. For instance, a surface acoustic wave (SAW) filter can be used for this purpose.

Once the modulator 230 has mapped the digital data signal onto the carrier waveform generated by the oscillator 238, the warning signal is sent to an RF power amplifier 242 for further processing. The RF power amplifier 242 amplifies the modulated warning signal to the required RF power level for transmission. The RF power level must be sufficient to feed the transmitter antenna 140. A band-pass filter 246 is used to remove any additional harmonics and distortion from the warning signal that is sought to be transmitted before the signal reaches the antenna 140. Any conventional band-pass filter suitable for this purpose may be used, such as a low-cost LC filter. The use of the D/A convertor on the input of the modulator enables such a filter 246 to be used, eliminating the need for a narrow signal bandwidth filter. The warning signal, complete with the digitally encoded data and other hazard identification information, is output from the band-pass filter 246 and placed over the air through the antenna 140. The transmitter 200 further includes additional circuitry to ensure that the transmitted signal level is properly maintained. This is accomplished through an RF power coupler 250 that includes a feedback loop to a power detector 254. The power detector 254 converts RF signal levels into an output voltage that is proportional to the input signal voltage. The power detector 254 may be implemented using a simple diode detector. The feedback loop 258 is input to a voltage comparator 218 to verify that the output power of the power detector 254 is above the minimum required signal level. Through this feedback loop 258, the power detector 254 and voltage comparator 218 can maintain the proper RF signal level at the RF power coupler 250 at the input to the antenna 140.

In additional to these components and devices, the fixed frequency transmitter 200, includes a power source 222, which drives the circuitry. This power source 222 may be a stand-alone battery or, alternatively, may draw on any other power source available at the transmitter location, such as a battery for an emergency vehicle, bus, or the like. The fixed frequency transmitter 200 further makes use of a voltage regulator 226, which is used to hold a constant voltage within the transmitter circuitry. A voltage regulator 226 is particularly useful where the transmitter is installed on an emergency vehicle, which draws on a battery between 10 to 14 volts, and the transmitter 200 requires only a constant voltage of 6 volts. In such instances, the voltage regulator 226 can appropriately adjust the voltage driving the fixed frequency transmitter 200 circuitry.

Figure 3:
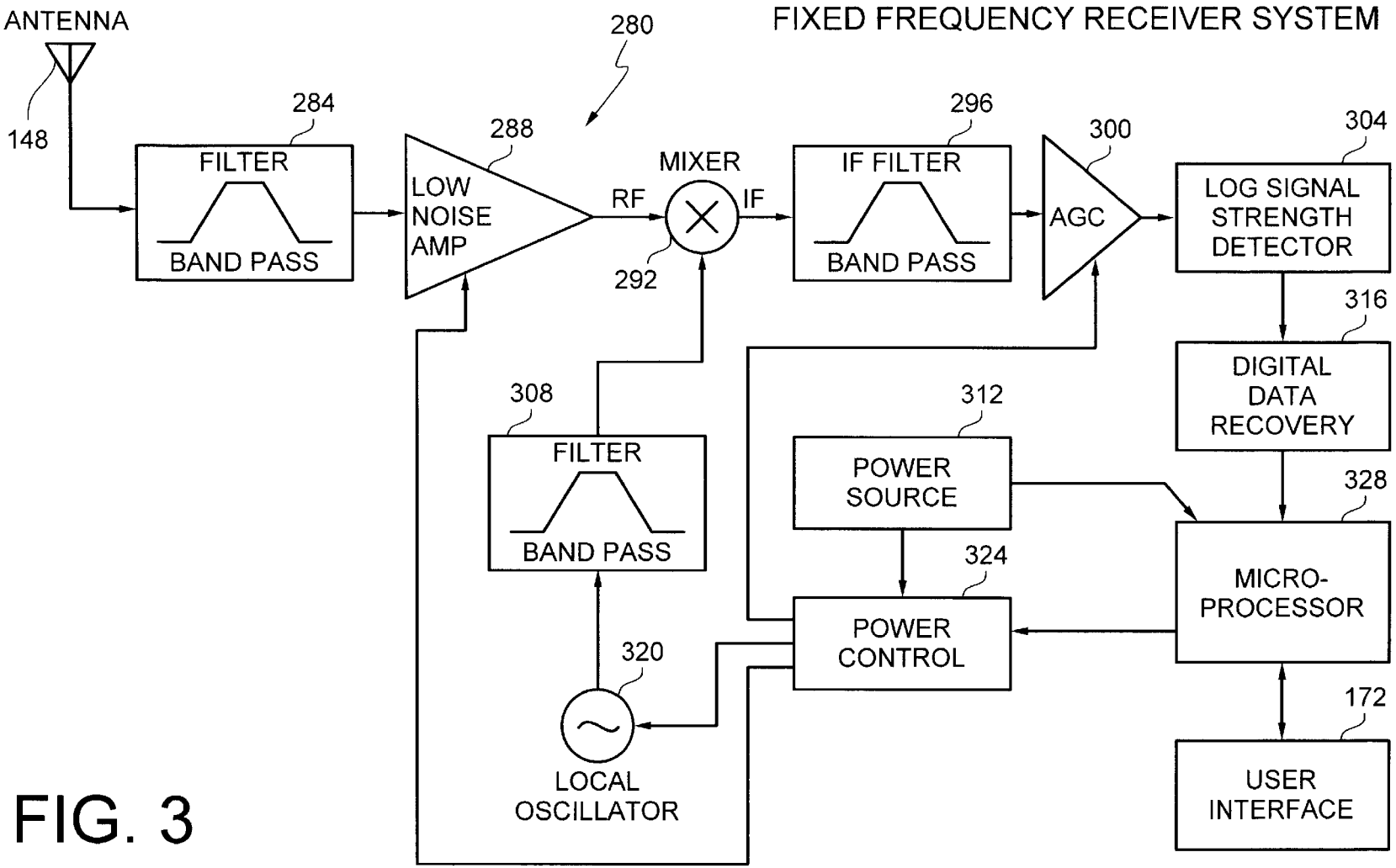
FIG. 3 is a block diagram illustrating a fixed frequency receiver system suitable for use in the radio warning system of the present invention.

Using the configuration depicted in FIG. 2, a digitally-encoded warning signal can be transmitted over the air through antenna 140. This warning signal will be received by any receivers operating within the effective range (i.e., 2500 feet) of the system. For a fixed frequency system, a fixed frequency receiver should be used for warning signal reception, such as the receiver 280 illustrated in FIG. 3. As shown in FIG. 3, a digitally-encoded warning signal may be received through an antenna 148 and fed to a band-pass filter 284. The band-pass filter may be any commercially available band-pass filter, such as an LC tuned filter, that is capable of removing out-of-band signals. Such a filter 284, however, should have an in-band insertion loss of 6 dB or less. The output of the band-pass filter 284 is fed to a low noise amplifier 288. The low noise amplifier 288 should include a relatively high signal-to-noise ratio to improve or otherwise maintain the overall system noise figure. For example, a low noise amplifier 288 having a gain between 8 to 18 dB and a noise figure of less than 3 dB is acceptable. The output of the low noise amplifier is an RF signal that is feed to a mixer 292 which converts the RF signal into a lower intermediate frequency (IF) waveform.

As in the transmitter, the fixed frequency receiver 280 makes use of a local oscillator 320 that is passed through a band-pass filter 308 to eliminate unwanted harmonics from the oscillator 320. The waveform generated by the local oscillator 320 and passed through the band-pass filter 308 to the mixer 292 provides a frequency reference for the mixer 292 and is used by the mixer 292 to down convert the received warning signal from an RF waveform to an IF waveform. The IF waveform is subsequently fed into an IF band-pass filter 296. An IF frequency of 10.7 MHZ, which is an industry standard frequency, can be used. The IF band-pass filter 296 is used to remove any out-of-band signals and harmonics. The filtered IF waveform is input into an automatic gain control (AGC) circuit, which is simply an amplifier that automatically varies its gain to maintain a constant output level over a very large range of input levels. The output of the AGC circuit 300 is input into a log signal strength detector 304 that logarithmically scales the signal so that its output is measured in units of dB/volt. The log detector 304 outputs a voltage that is proportional to the level of the detected signal. The log detector 304 accomplishes its scaling function by using an appropriate control voltage obtained from the AGC circuit 300. This information is passed to the AGC circuit 300, in part, from a power control device 324. The power control device 324 is driven by a power source 312, which may be a battery within the receiver 280 itself or an external source, such as a cigarette lighter in a motor vehicle. The power control device 324 maintains the proper power levels input to the local oscillator 320 and low noise amplifier 288. Both the power control device 324 and the power source 312 are electrically connected to a microprocessor 328.

In addition to supervising the operations of the power control device 324, the microprocessor 328 processes the digital data carried by the received warning signal. After the received warning signal has been appropriately scaled by the log signal strength detector 304, as described above, the signal is passed to a digital data recovery unit 316. The digital data recovery unit 316 reads the analog waveform that is output from the log signal strength detector 304 and converts the signal into the digital data sequence generated at the transmitter for further processing by the microprocessor 328. The digital data recovery unit 316 may perform these functions in a number of ways, including using voltage level comparators that output a logic string of ones and zeros. Under this implementation, these comparators may make use of a tracking reference that helps maintain appropriate signal strength and reduces the likelihood of noise induced errors. The recovered digital data from the digital recovery unit 316 is fed into the microprocessor 328. The microprocessor 328, like the one used at the transmitter, is intended to be a fully integrated microcontroller that includes built-in RAM, ROM, firmware and other microcontroller characteristics, which are required to receive the recovered digital data and trigger appropriate status indicators on a user interface 172. As in the transmitter, a MicroChip PIC16C61 can be used for this purpose. The microprocessor 328 processes the digital data recovered from the digital data recovery unit 316 and provides the appropriate stimulus to the user of the receiver 280 through the user interface 172, which may include sound, light or tactile indicators identifying specific emergency conditions. The user interface 172 may also include an auxiliary output to provide an interface to other devices, such as a GPS mapping display.

Figure 4:
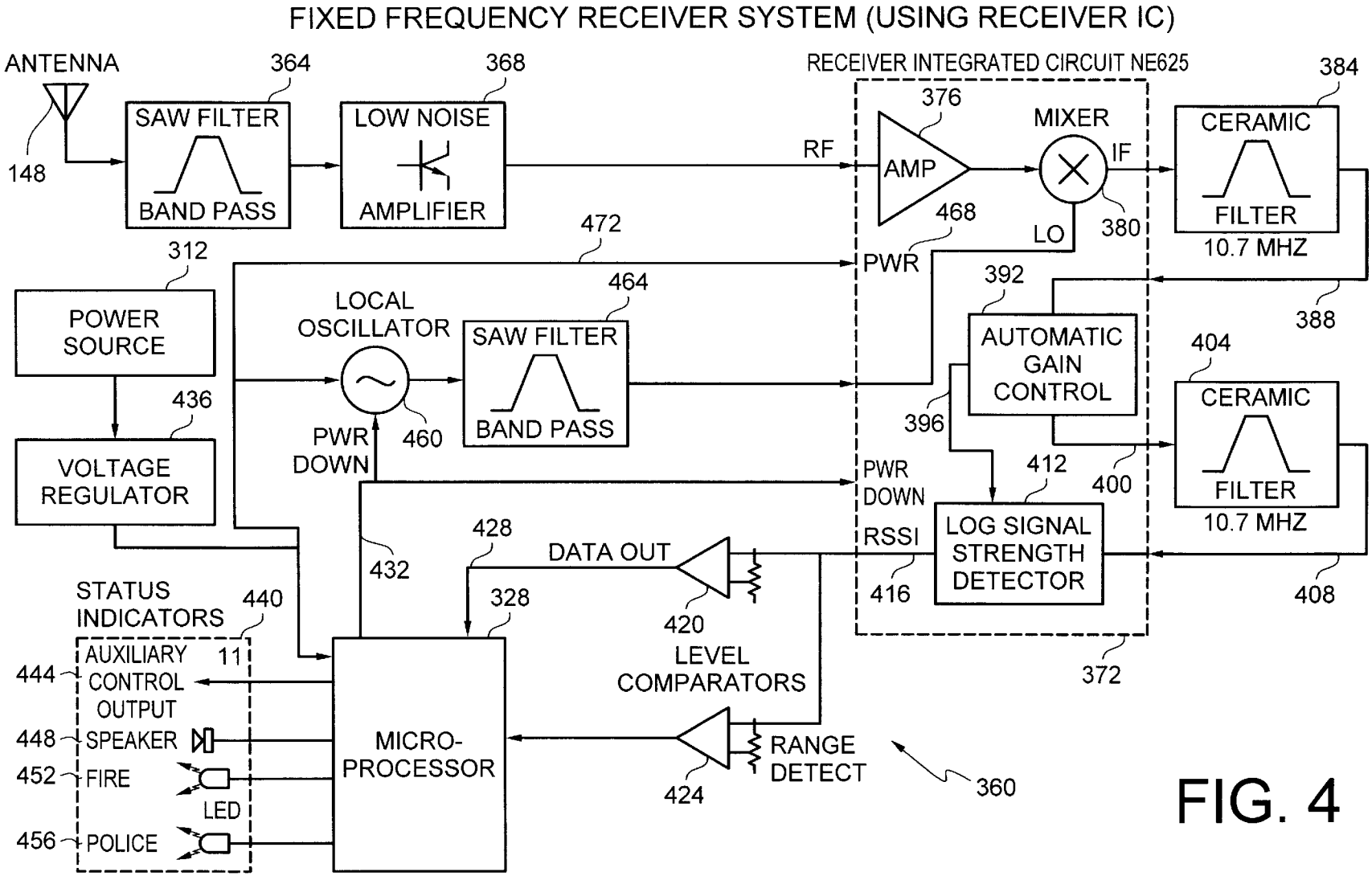
FIG. 4 is a block diagram of a more detailed embodiment of a fixed frequency receiver system.

FIG. 4 illustrates a more detailed embodiment of the fixed frequency receiver system depicted in FIG. 3. As shown in FIG. 4, the RF warning signal is received through the antenna 148 and passed to a surface acoustic wave (SAW) band-pass filter 364. The SAW filter 364 removes most of the out-of-band signals in the received RF waveform. Although a SAW filter is a preferred design choice because of its size, price and performance characteristics, an LC-tuned filter may be a reasonable design alternative, provided that it maintains an in-band insertion loss of 6 dB or less.

The received RF waveform is passed from the SAW band pass filter 364 to a low noise amplifier 368. As in the previous embodiment, the low noise amplifier 368 should maintain a gain of between 8 to 18 dB with a noise figure of 3 dB or less in order to maintain an appropriate overall system noise figure. These characteristics are important to offset the poor noise figure of the receiver integrated circuit NE625 372. The use of the NE625 integrated circuit 372 is an economical, low-cost example of the design depicted in FIG. 3. The NE625 receiver integrated circuit makes use of an amplifier 376, which receives the RF warning signal from the low noise amplifier 368 and passes this signal to the mixer 380. The mixer also makes use of a local oscillator wave form that was generated by a local oscillator 460 and passed through a local oscillator SAW band-pass filter 464, as in the previous version of the design. The mixer 380 is used to down convert the RF input signal to an IF signal at a particular IF frequency, such as the industry standard 10.7 MHZ. The mixer 380 accomplishes this by combining the two frequencies (i.e., the frequencies from the RF signal and the local oscillator signal) to form sum and difference frequencies at the output of the mixer 380, which produces an IF version of the received warning signal. This IF signal is passed to a ceramic band-pass filter having a bandwidth of 110 Khz. The ceramic filter 384 removes undesirable harmonics from the IF output. An automatic gain control (AGC) device 392, which is included in the NE625 receiver integrated circuit, accepts the output of the ceramic filter 384 and outputs the signal over two outputs 396 and 400. The signal is passed over output 400 to another ceramic filter 404, which further processes the waveform for input into a log signal strength detector 412. The log signal strength detector scales the received signal to an appropriate level. The signal that is output from the AGC 392 over output 396 is also input to the log signal strength detector 412. The log signal strength detector 412 may be implemented using any device capable of such scaling functions, including a received signal strength indicator (RSSI) 416.

At the output of the log signal strength detector, the scaled output signal is passed to level comparators 420 and 424 that are used to recover the on/off keyed digital data and information that was mapped into the waveform at the transmitter. The level comparators 420 and 424 convert the digital data and information carried by the waveform back into a digital data sequence that can be read and interpreted by the microprocessor 328. The level comparators 420 and 424 provide the circuitry of the fixed frequency receiver 360 with the ability to measure and determine the signal strength of the received warning waveform signal. In this way, the level comparators 420 and 424 can provide a microprocessor with an indication as to the strength of the signal and, therefore, whether the potential hazard or other event from which the radio warning signal was generated is near or far way.

The microprocessor 328 may be implemented using the same microprocessor 328 used in the previous design of the fixed frequency receiver shown in FIG. 3. The circuitry in the fixed frequency receiver 360 of FIG. 4 also makes use of a power source 312 and a voltage regulator 436 much like the previous design. The power source 312 may be implemented through a number of different power sources, including a battery within the receiver unit itself, or drawing on an external power source such as a cigarette lighter in an automobile. The voltage regulator 436 is used, as in the previous design, to maintain appropriate voltage levels throughout the circuitry. The microprocessor 328 processes the data output by the level comparator 420 over connection 428 and processes this data to determine the type of hazard or emergency that prompted initiation of the radio warning signal. The microprocessor 328, in turn, can trigger any number of status or alarm indicators on a user interface 440, such as an audible speaker 448, an LED 452 or 456, or other tactile alarm, any of which could indicate a particular type of approaching emergency vehicle, such as a fire truck or police car, which has initiated the warning signal transmission, as well as other information concerning another potential hazardous condition. An auxiliary control output 444 may be used to pass other information to an external device co-located at the receiver. For example, the auxiliary control output 444 may provide an interface to a GPS mapping display so that transmitter location coordinates can be displayed.

Using the fixed frequency transmitter 200 depicted in FIG. 2 and either receiver configuration 280 or 360 depicted in FIGS. 3 or 4, the present invention can be implemented using a fixed frequency system of operation that is advantageous as a low-cost design. In addition to its hardware components, the fixed frequency implementation can make use of firmware or software that complements the system's operation. Although this firmware or software may operate in a number of ways, as recognized by those skilled in the art, certain functions should be included in any implementation.

For instance, in a preferred embodiment, the microprocessor 204 should be fully powered up when the system is activated. At the transmitter, the microprocessor 204 should read the potential hazard identification data from non-volatile memory 208 and place this information in the microprocessor's RAM memory so that it may be accessed rapidly. In this way, the system can efficiently accommodate burst transmissions during system operation. The microprocessor 204 waits for an activation switch to be triggered and, once such a switch is activated, will initiate generation of an appropriate data sequence. This sequence may include a sync signal and data specific to a particular potential hazard. The sync pulses are included in the signal at the beginning and end of each digital bit sequence to enable each receiver to recognize a particular signal. Each bit sequence can vary in length. However, a uniform format and length may also be used, such as a series of 25 short RF on/off pulses that are spaced apart in time (e.g., 1 millisecond apart). A convenient format for the digital data bit sequence may be a non-return-to-zero (NRZ) format which is well known in the art. The microprocessor 204 provides the D/A convertor 212 with the digital bit sequence used to indicate an alarm condition and makes use of its software to prompt the D/A convertor 212 to transmit the sequence to the modulator 230. The digitally coded sequences that are passed to D/A convertor 212 may be calculated and calibrated in advance during development and calibration of the product, using a filter design program. The D/A convertor is fed respective digital data sequences which are stored in ROM as part of its software functions, eliminating the need for high order low pass filters in the hardware configuration, as previously indicated. Through the use of OOK modulation, each data bit that is set to 1 prompts the software used by the microprocessor 204 to check the status of the RF level detector 254. In this way, the transmitter 200 software can detect faults in the transmission process and, for example, trigger a fault light (not shown) on the transmitter unit 200.

In order to generate an entire digital bit sequence, warning specific identification data is sent with very brief pauses between every data word generated by the microprocessor 204 and D/A convertor 212. All the data words are separated by brief pauses and combine together, with these pauses, to make a complete and full packet (single burst) of data. Once a full packet of data has been generated and sent to the modulator 240 for processing into an RF waveform, the transmitter 200 software pauses for a brief period (e.g., 0.2 seconds) between the complete data packets (bursts) to allow the microprocessor 204 to read the status of any activation switches in the user interface 112. Where an activation switch within the user interface 112 remains triggered, such that it is still on, this sequence of generating a warning specific data sequence begins again.

Once the warning-specific digital data sequence is transmitted as part of the RF waveform over the air through the antenna 140 shown in FIG. 2, the RF signal transmissions may be received by either fixed frequency receiver system 280 or 360 depicted in FIGS. 3 and 4. The microprocessor 328 depicted in these figures likewise makes use of firmware or software in order to process received RF waveforms carrying a specific digital data sequence. Although a variety of functions may be included, the receiver software or firmware should perform several functions in order to complement the receiver 280 or 360 hardware components.

For instance, this receiver software should initiate a monitoring function that monitors received signals for sequences for having received pulses of 1's and 0's. If a pulse sequence having the same timing as that of the transmitter 200 is detected, the software will synchronize itself on the last sync pulse and begin sampling data at the same rate and timing as used by the transmitter 200. The received data words will be compared bit by bit with expected activation codes that are stored at the receiver 280 or 360. If any bit error in a data word is detected, the receiver 280 or 360 software will discontinue its sampling function and will return to monitoring any received signals for sync pulses. Once the receiver 280 or 360 software recognizes a complete activation code, the microprocessor 328 will trigger an appropriate status indicator in the user interface 172 or 444.

It is preferred that the microprocessor 328 software will be programmed such that it will include a time out feature of 5 seconds in length. In this way, as the receiver 280 or 360 continues to receive activation codes and digital data sequences a specific indicator that was activated based on a received activation code will remain activated for 5 seconds after the last burst transmission has been received. Thereafter, where no burst transmission is received within the next 5 seconds, the indicator will be deactivated. In this manner, the indicator will remain activated even where a transmission is temporarily lost by the receiver 280 or 360 due to interference or some other effect preventing reception. Once the transmitter has moved out of range and the 5 second interval has expired, the indicator will be deactivated by the software. Using this complement of hardware and software, the fixed frequency system can be used as a reliable and cost-effective implementation of the present invention.

The present invention may also be implemented using a spread spectrum system implementation. This implementation provides improved reliability over the fixed frequency system implementation, at the expense of increased cost. A spread spectrum system implementation will have, for example, significantly improved performance over the fixed frequency system in the presence of continuous interference or jamming and will remain largely unaffected by multipath distortion. Spread spectrum techniques, which are well known in the art, differ from a fixed frequency technique in that spread spectrum employs a transmission bandwidth that is several orders of magnitude greater then the minimum required bandwidth for transmission of a single signal. Spread spectrum signals are spread across a very large bandwidth, and when compared with a typical transmission of digital information or data, are pseudorandom and have noise-like properties. Although there are several methods of implementing spread spectrum transmissions, such as through direct sequence, pseudonoise code generators, a frequency hopping spread spectrum transmission technique will be described here.

Frequency hopping involves a periodic change of transmission frequency. A frequency hopping signal may be regarded as a sequence of modulated data bursts with a time varying, pseudorandom carrier frequency. A frequency hopping signal "hops" over a frequency band that includes a number of channels or frequency subsets. In a typical implementation, data transmitted by a frequency hopping technique is accomplished by hopping the transmitter carrier signal to seemingly random channels which are known by only the desired receiver. On each channel small bursts of data can be sent using conventional narrowband modulation before the transmitter hops again.

Figure 5:
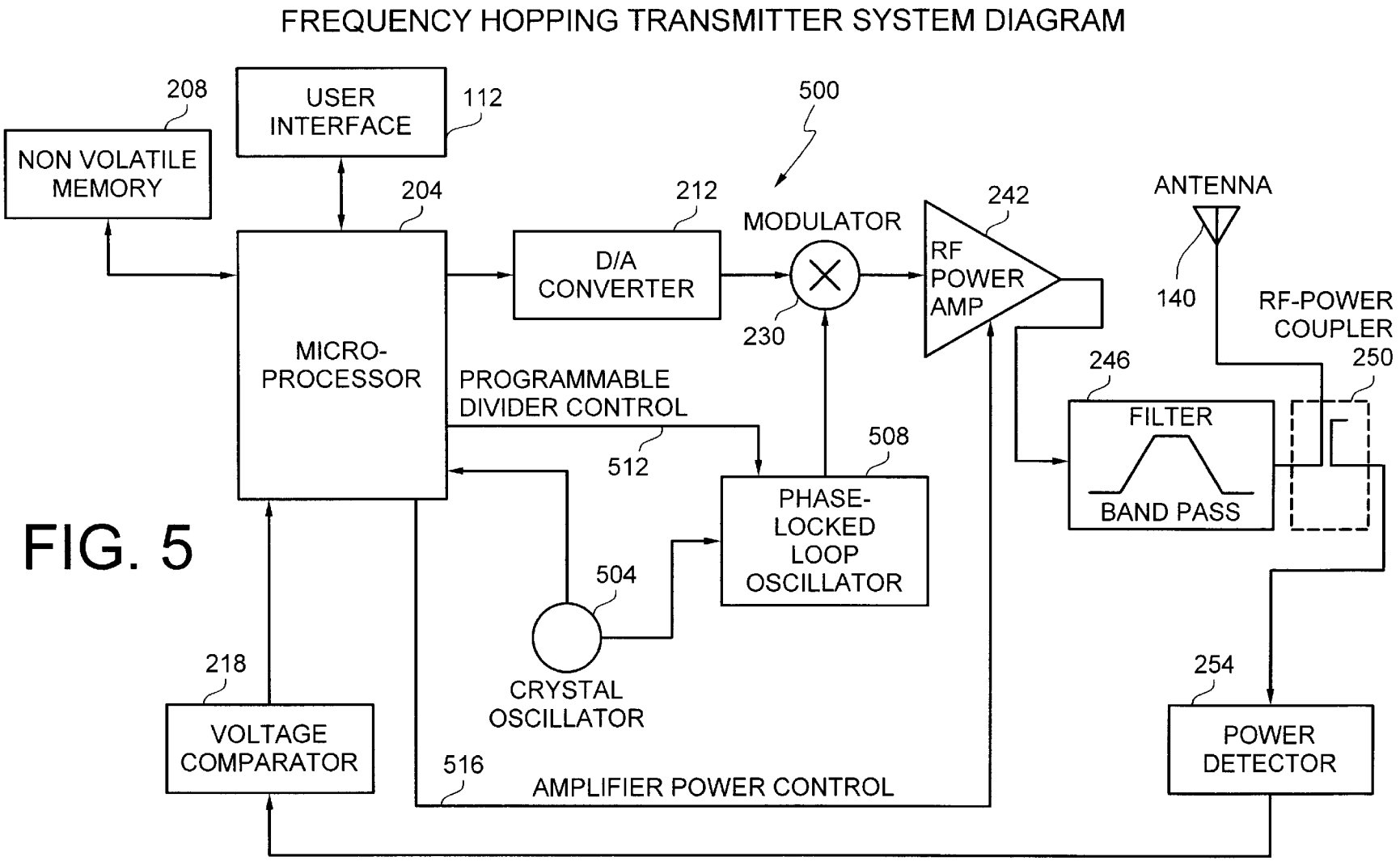
FIG. 5 is a block diagram of a frequency hopping transmitter system for use in the radio warning system of the present invention.

For purposes of the present invention, a frequency hopping transmission technique can be implemented using the frequency hopping transmitter system depicted in FIG. 5. Under this design, it is assumed that a given warning signal transmission 500 will hop over the frequency range of 902–928 MHZ, which is one of the primary frequency bands that has been set by the FCC for frequency hopping devices. Although various hopping rates may be used to carry out the present invention, the transmitter 500 can hop across this frequency range at a rate of 4 or more hops per second. The frequency range can, in turn, be divided into 20 or more hopping channels evenly spaced across the band in order the minimize any deleterious effects from interference or multipath distortion. Other hopping rates and numbers of hopping channels may likewise be used to carry out the present invention, as recognized by those skilled in the art.

As shown in FIG. 5, the frequency hopping transmitter 500 can be implemented using many of the same components that form a part of the fixed frequency system transmitter 200 shown in FIG. 2. For example, the frequency hopping transmitter system 500 is controlled by the microprocessor 204. As in the fixed frequency design, the microprocessor 204 interfaces with the user interface 112, which initiates warning signal transmission. Such transmissions may be initiated in the same way as in the fixed frequency system, through the use of activation switches in the user interface 112. These activation switches may be manually activated by transmitter operator or, alternatively, automatically activated by some other triggering device, which is coupled or otherwise electrically connected to a separate switch, such as the switch that initiates a siren in an emergency vehicle. Once an activation switch is triggered, the microprocessor 204 accesses the nonvolatile memory 208 to extract the appropriate digital data or information relating to a particular potential hazard. The microprocessor 204 may also receive additional data, such as GPS coordinates, from an external device through the user interface 112. The microprocessor 204 passes this information in digital format to the D/A convertor 212, which converts this data into an analog waveform. The analog waveform is input to the modulator 230, as in the fixed frequency design. The carrier waveform generated by a crystal oscillator 504 is modulated by the digital data sequence to, in turn, generate an appropriate signal.

Unlike the fixed frequency design, however, the frequency hopping transmitter 500 includes a phase locked loop (PLL) oscillator 508 which enables the carrier waveform to hop from reference frequency to reference frequency, thereby creating a set of hopping waveforms. This is implemented in part through programmable divider control signals 512 which are provided to the PLL oscillator 508 by the microprocessor 204. The system makes use of software that controls the rate at which the carrier waveform hops (e.g., 4 hops per second) and the channel to which the modulated signal will hop. The output of the modulator 230 in the frequency hopping transmitter 500 undergoes further processing in virtually the same manner as in the fixed frequency system. Thus, the frequency hopping transmitter 500 also makes use of a bandpass filter 246 to remove any harmonics and distortion from the transmitted signal before it is fed to the antenna 140.

As in the fixed frequency system, the RF power coupler 250 is used for feed-back to ensure that the transmitted signal level includes the proper amount of energy prior to being fed into the antenna 140. For this purpose, the transmitter 500 may also use a power detector 254 to convert the RF signal into an output voltage that is proportional to the input signal level. As in the fixed frequency system, a simple diode detector is sufficient for this purpose. The frequency hopping transmitter 500 further uses a voltage comparator 218 to verify that the output of the power detector 254 is at an appropriate signal level for transmission, as part of the testing feedback loop. This information is fed to the microprocessor 204 so that appropriate adjustments in signal level, if required, can be made.

In implementing this frequency hopping transmitter 500 design, many modulation schemes may be used. As in the fixed frequency case, an OOK-digitally modulated signal may suffice. The warning signal transmission will be far less susceptible to signal degradation from interference or jamming since each signal is hopped across the transmission bandwidth. Alternatively, other modulation schemes, such as FSK, BPSK, QPSK, or QAM, may likewise be used. However, for the configuration depicted in FIG. 5, OOK modulation provides a low cost, reasonably reliable design alternative.

Figure 6:
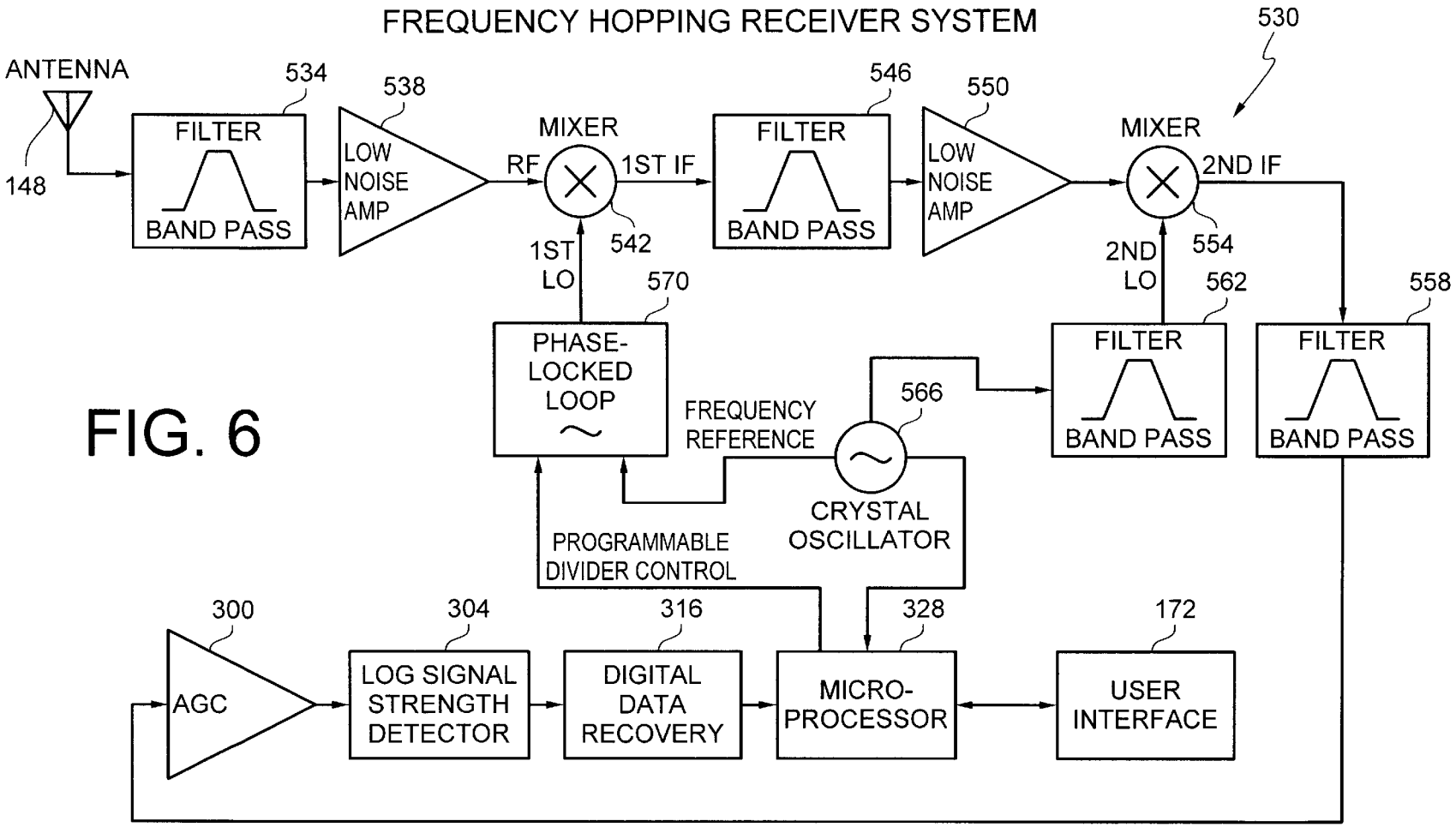
FIG. 6 is a block diagram of a frequency hopping receiver system.

In order to implement the frequency hopping transmission technique, the system should make use of a frequency hopping receiver, such as the one depicted in FIG. 6. As shown in FIG. 6, a frequency hopping receiver 530 can be implemented using a similar receiver configuration as in the fixed frequency system, with several modifications. However, various other designs are suitable for this purpose. For convenience here, the frequency hopping receiver 530 depicted in FIG. 6 is merely a simple extension of the fixed frequency receiver described previously, with several differences. The primarily differences involve the use of a phase lock loop (PLL) device 570 and the use of a dual conversion design that uses two mixers in order to maximize receiver performance and reduce the need for additional image rejection filters.

As shown in FIG. 6, a particular warning signal may be received by the antenna 148 as an RF waveform, which is input to a band-pass filter 534. The band-pass filter 534 has a pass band of 902–928 MHZ, which corresponds to a frequency range set by the FCC for frequency hopping devices. The band-pass filter 534 thus includes a pass band that is wide enough to pass the entire hopping range of the transmitted signal that is received by the receiver 530. Any commercially available band-pass filter may suffice for this application, provided that the chosen filter has a low insertion loss of 4 dB or less.

The output of the band-pass filter 534 is passed to a low noise amplifier 538, similar to that used in the fixed frequency system. This low noise amplifier 538 should be rated so as to maintain or improve the overall system noise figure. Thus, for example, a low noise amplifier having a gain of 8 to 18 dB and a noise figure of 3 dB or less should be used so as to offset the poor noise figure of the first mixer that is required by the dual conversion design. As an alternative to the low noise amplifier, a MMIC (monolithic microwave integrated circuit) amplifier may also be used, albeit at increased cost and power consumption.

The output of the low noise amplifier 538 provides the first mixer 542 of the dual conversion design with the RF signal that was received by the frequency hopping receiver 530. Under this design, this first mixer 542 down converts the RF signal to an IF frequency of 46.7 MHZ as an initial IF frequency. The down conversion process is performed, in part, by the PPL device 570, which serves as a first local oscillator in the frequency hopping receiver 530 design. This PLL device 570 is used by the mixer 542 to down convert the RF signal to a first IF frequency. A first IF frequency of 46.7 MHZ is a simple design choice for the dual conversion design, as recognized by those skilled in the art, although others may be used. This first IF signal is passed to band pass filter 546, which is a band pass filter centered at 46.7 MHZ and filters out all out-of-band components. The signal is subsequently provided to another low noise amplifier 550, which may be used to maintain an appropriate signal-to-noise level. This low noise amplifier 550 may be excluded from this receiver 530 configuration, depending on the overall losses in the configuration.

The output of the low noise amplifier 550 is passed to a second mixer 554 that is used to down convert the first IF signal to a second IF frequency of 10.7 MHZ, which is an industry standard IF frequency that is likewise used in the fixed frequency system. This second down conversion process is performed, in part, through the use of a crystal oscillator 566 which outputs a square wave at 12 MHZ. The third harmonic of this waveform is at 36 MHZ and is used as a the source for the second local oscillator for the mixer 554. The 36 MHZ and is used as the source for a second local oscillator for the mixer 554. The 36 MHZ waveform generated by the crystal oscillator 566 is passed through a band pass filter 562 prior to being provided to the mixer 554 for down conversion in order to remove any unwanted harmonics. The output of the mixer 554 produces a signal centered at the IF frequency of 10.7 MHZ, and which is input to another band-pass filter 558. This band-pass filter 558 removes any out-of-band frequencies, harmonics and other distortions accompanying the signal.

The output of the band-pass filter 558 is provided to an automatic gain control (AGC) device 300, a logic signal strength detector 304, a digital data recovery unit 316, and the microprocessors 328 for further processing, as in the fixed frequency design. Using these components, the digital data sequence and other information corresponding to the specific potential hazard that generated the transmission of a particular warning signal can be extracted and processed by the microprocessor 328. The microprocessor 328, in turn, activates the appropriate indicators or alarms at the user interface 172, as previously described.

Figure 7:
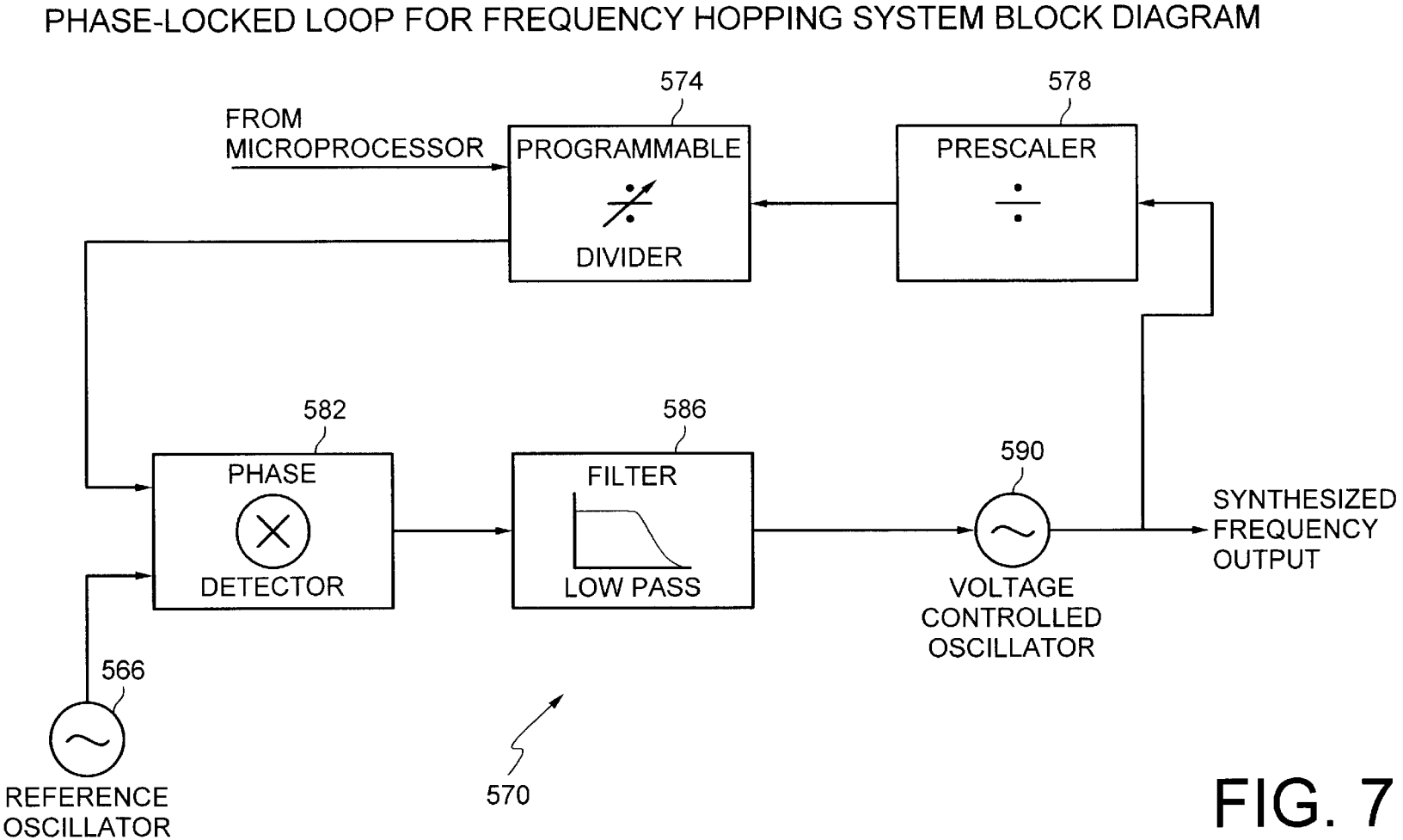
FIG. 7 is a schematic of a phase locked loop circuit for use in a frequency hopping system.

The microprocessor 328 controls the PLL device 570 and, among other things, instructs the phase lock PLL device 570 to scan through all frequency hopping channels within the input range, searching for a properly coded warning signal transmission. This is accomplished using programmable divider control signals sent from the microprocessor 328 to the PLL device 570. This PLL operation may be implemented using various components, including those depicted in FIG. 7. As shown in FIG. 7, a particular PLL configuration 570 suitable for the present invention is illustrated. A variable programmable divider 574 is loaded with a divide ratio from the microprocessor 328. An incoming frequency is divided by this divide ratio and output to a phase detector 582 in logic level (i.e., square wave) form. A prescaler 578 is used to divide frequencies to lower frequencies that can be reliably detected by the logic level programmable divider stage 574.

The phase detector 582 makes use of the output of the programmable divider stage 574 and compares this input frequency to the input frequency from a reference oscillator 566 and determines which input is higher or lower in frequency. The phase detector 582 subsequently outputs an analog voltage that is proportional to the amount of error in frequency. This output is passed to a low pass filter 586, typically referred to as a loop filter, which is used to prevent oscillation and excessive phase error output. This filter 586 determines the response time and stability of the PLL 570 in response to changes from the divider ratio number loaded into the programmable divider stage 574. The output of the low pass filter 586 is provided to a voltage controlled oscillator 590, which drives the prescaler 578 as well as the first mixer of the frequency hopping receiver system. Any commercially available voltage control oscillator will suffice for this application, provided that it may vary over the required local oscillator range of 850–900 MHZ (if the 902–928 MHZ band is used). The reference oscillator 566, which drives one input of the phase detector 582, outputs a low frequency logic level square waves signal having a reference frequency of 12 MHZ. This same reference oscillator 566 may also be used for driving the microprocessor 328, as shown in FIG. 6.

The frequency hopping transmission implementation embodied by the FIGS. 5–7 also makes use of software in order to carry out its operations. This software operates very similar to the software used for the fixed frequency system and described above, with minor changes. For example, when the frequency hopping transmitter system 500 is activated, the software will set the PLL device 508 shown in FIG. 5 to a specified starting frequency. After a few milliseconds have passed and the PLL device 508 is able to lock on, the microprocessor 204 will make use of its software to provide a specific data sequence as in the fixed frequency system implementation. At the end of each full data packet, the software will load a new PLL frequency value from a predetermined table of frequency steps stored in the non-volatile memory 208. This step sequence is a pseudorandom list that is calculated and loaded into the non-volatile memory 208 during calibration and testing of the transmitter device 500. In the preferred system, no two transmitters have the exact same sequence.

The frequency hopping receiver system 530 depicted in FIG. 6 likewise makes use of software in a manner similar to that used in the fixed frequency system implementation. The microprocessor 328 makes use of software that instructs the receiver 530 to begin monitoring the lowest frequency in the reception band (i.e., the first channel). The PLL device 570 will be tuned to the lowest frequency in the reception band for a period of 4 milliseconds, monitoring the band for sync pulses. If a proper sync pulse is not detected, the software loads the PLL device 570 with the next channel number and repeats the monitoring process. This scan continues until a proper sync pulse is detected. Once a sync pulse is detected, the software waits for the last sync pulse and then begins the data sampling processes as in the fixed frequency system design. Although many scan rates may be used with the system, the frequency hopping receiver 530 system may make use of a scan rate that is many (e.g., 25) times faster then the transmitter hopping rate. In this manner, the receiver 530 is likely to locate a transmitter sync pulse sequence on every scan. If, however, a false (noise generated) sync pulse is detected on a channel, the software will continue the sampling process and compare received and stored activation codes. If there is no match of activation codes, the software will abort the sampling process and continue scanning for sync pulses as before. The frequency hopping receiver 530 software otherwise functions similarly, if not identically, to the software used in the fixed frequency receiver design. In either design implementation, it should be noted that various other software sequences and steps may be used to accomplish the functions and features of the present invention, as will be recognized by those skilled in the art.

The present invention has been described with reference to several exemplary embodiments. However, it will be readily apparent to those skilled in the art that it is possible to embody the invention in specific forms other than those of the exemplary embodiments described above. This may be done without departing from the spirit or scope of the invention. These exemplary embodiments are merely illustrative and should not be considered restrictive in any way.

The scope of the invention is given by the appended claims, rather than the preceding description, and all variations and equivalents which fall within the range of the claims are intended to be embraced therein.

What is claimed is:

1. A radio warning system for alerting system users of a potential hazardous condition so that the potential hazardous condition may be avoided, comprising:

transmission means for generating a radio warning signal carrying a digital data sequence that includes a trigger code along with identification information concerning the potential hazardous condition and for transmitting the radio warning signal in repeated transmission bursts separated by pauses; and means for receiving the radio warning signal, including:

means for processing the radio warning signal;

means for extracting the digital data sequence carried by the radio warning signal;

means for interpreting the identification information included in the digital data sequence; and means for providing a warning indication of the potential hazardous condition in response to the interpreted identification information.

2. The radio warning system of claim 1, wherein the transmission means transmits the radio warning signal in repeated transmission bursts so that at least one of the repeated radio warning signal transmissions can be received by each system user within the effective range of the system without error caused by interference or multipath distortion.

3. The radio warning system of claim 1, wherein the trigger code is of sufficient length to minimize the likelihood of false triggers.

4. The radio warning system of claim 1, wherein the transmission means includes user interface means for initiating the generation of the radio warning signal and a microprocessor for generating the digital data sequence that is carried by the radio warning signal.

5. The radio warning system of claim 1, wherein the extracting means is a digital data recovery device for extracting the digital data sequence that includes the information concerning the potential hazardous condition.

6. The radio warning system of claim 1, wherein the warning indicating providing means includes at least one indicator that alerts each system user of the potential hazardous condition in response to the extracted digital data sequence.

7. The radio warning system of claim 1, wherein the transmission means is located on a mobile host that presents system users with a threat of collision as the potential hazardous condition.

8. The radio warning system of claim 7, wherein the mobile host may be an emergency vehicle, bus, train, construction vehicle, mail or package delivery vehicle, or other transport carrier capable of collision with one of the system users, and wherein the identification information in the digital data sequence includes at least one code identifying the specific type of transport carrier posing the threat of collision.

9. The radio warning system of claim 1, wherein the identification information in the digital data sequence includes GPS coordinates for the location of the transmission means.

10. The radio warning system of claim 1, wherein the identification information in the digital sequence includes at least one code identifying the transmission means by unique code number to facilitate identification of sources of false warning signal transmissions.

11. The radio warning system of claim 1, wherein the receiving means is located in a motor vehicle, such that one of the system users within the motor vehicle will be alerted of the potential hazardous condition upon reception of the radio warning signal.

12. The radio warning system of claim 1, wherein the receiving means is a portable, hand-held device, such that one of the system users carrying the device will be alerted of the potential hazardous condition upon reception of the radio warning signal.

13. The radio warning system of claim 1, wherein the radio warning signal is transmitted using fixed frequency transmission.

14. The radio warning system of claim 1, wherein the radio warning signal is transmitted using spread spectrum transmission.

15. The radio warning system of claim 14, wherein the spread spectrum transmission is accomplished using frequency hopping transmission.

16. A radio warning system for alerting system users of a potential hazardous condition so that the potential hazardous condition may be avoided, comprising:

a transmitter for transmitting a radio warning signal that carries a digital data sequence that includes information concerning the potential hazardous condition, wherein the transmitter includes a transmitter user interface for initiating the generation of the warning signal, a microprocessor for generating the digital data sequence, and transmitter signal processing components for modulating the digital data sequence onto a radio warning waveform to produce the radio warning signal and for preparing the radio warning signal for transmission to the system users who are within the effective range of the radio warning system;

at least one receiver for receiving the radio warning signal and interpreting the digital data sequence carried by the radio warning signal, wherein each receiver includes receiver signal processing components for demodulating and processing the received radio warning signal, a digital data recovery device for extracting the digital data sequence that includes the information concerning the potential hazardous condition, and a receiver user interface that includes at least one indicator that alerts each system user who has received the radio warning signal of the potential hazardous condition in response to the extracted digital data sequence; and wherein the radio warning signal is transmitted by the transmitter in repeated transmission bursts so that at least one of the repeated radio warning signal transmissions can be received by each system user within the effective range of the system, and wherein successive bursts are separated by pauses.

17. The radio warning system of claim 16, wherein the at least one indicator is an audible, visual or tactile alarm.

18. The radio warning system of claim 16, wherein the transmitter is located on a mobile host that presents system users with a threat of collision as the potential hazardous condition.

19. The radio warning system of claim 18, wherein the mobile host may be an emergency vehicle, bus, train, construction vehicle, mail or package delivery vehicle, or other transport carrier capable of collision with one of the system users, and wherein the information in the digital data sequence includes at least one code identifying the specific type of transport carrier posing the threat of collision.

20. The radio warning system of claim 16, wherein the information in the digital data sequence includes GPS coordinates for the location of the transmitter.

21. The radio warning system of claim 16, wherein the digital data sequence includes a trigger code that is of sufficient length to minimize the likelihood of false triggers.

22. The radio warning system of claim 16, wherein the information in the digital sequence includes at least one code identifying the transmission means by unique code number to facilitate identification of sources of false warning signal transmissions.

23. The radio warning system of claim 16, wherein the receiver is located in a motor vehicle, such that one of the system users within the motor vehicle will be alerted of the potential hazardous condition upon reception of the radio warning signal.

24. The radio warning system of claim 16, wherein the receiver is a portable, hand-held device, such that one of the system users carrying the device will be alerted of the potential hazardous condition upon reception of the radio warning signal.

25. The radio warning system of claim 24, wherein each radio warning signal is transmitted using fixed frequency transmission.

26. The radio warning system of claim 24, wherein each radio warning signal is transmitted using spread spectrum transmission.

27. The radio warning system of claim 26, wherein the spread spectrum transmission is accomplished using frequency hopping transmission.

28. A method for alerting system users of a potential hazardous condition so that the potential hazardous condition may be avoided, comprising the steps of:

generating a radio warning signal carrying a digital data sequence that includes identification information concerning the potential hazardous condition;

transmitting the radio warning signal using burst transmissions, wherein successive bursts in the burst transmissions are separated by pauses;

receiving the radio warning signal;

extracting the digital data sequence that includes the information concerning the potential hazardous condition; and alerting each system user who has received the radio warning signal of the potential hazardous condition in response to the extracted digital data sequence.

29. The method of claim 28, wherein the alerting step includes the step of activating an audible, visual or tactile alarm.

30. The method of claim 28, wherein the transmitting step is accomplished from a mobile host that presents system users with a threat of collision as the potential hazardous condition.

31. The method of claim 30, wherein the mobile host may be an emergency vehicle, bus, train, construction vehicle, mail or package delivery vehicle, or other transport carrier capable of collision with one of the system users, and wherein the identification information in the digital data sequence includes at least one code identifying the specific type of transport carrier posing the threat of collision.

32. The method of claim 28, wherein the information in the digital data sequence includes GPS coordinates for the potential hazardous condition.

33. The method of claim 28, wherein the digital data sequence includes a trigger code that is of sufficient length to minimize the likelihood of false triggers.

34. The method of claim 28, wherein the identification information in the digital sequence includes at least one code identifying the transmission means by unique code number to facilitate identification of sources of false warning signal transmissions.

35. The method of claim 28, wherein the receiving step is accomplished on a motor vehicle, such that users within the motor vehicle will be alerted of the potential hazardous condition upon reception of the radio warning signal.

36. The method of claim 28, wherein each radio warning signal is transmitted using fixed frequency transmission.

37. The method of claim 28, wherein each radio warning signal is transmitted using spread spectrum transmission.

38. The method of claim 37, wherein the spread spectrum transmission is accomplished using frequency hopping transmission.

39. A radio warning system for alerting system users of a potential hazardous condition so that the potential hazardous condition may be avoided, comprising:

transmission means for generating a radio warning signal carrying a digital data sequence that includes identification information concerning the potential hazardous condition and for transmitting the radio warning signal in repeated transmission bursts separated by pauses; and means for receiving the radio warning signal, including:

means for processing the radio warning signal;

means for extracting the digital data sequence carried by the radio warning signal;

means for interpreting the identification information included in the digital data sequence; and means for providing a warning indication of the potential hazardous condition in response to the interpreted identification information, wherein the means for receiving is configured to recognize a plurality of different possible hazardous conditions, and wherein the means for interpreting interprets the identification information by associating the identification information with one of the plurality of different possible hazardous conditions to generate one of a plurality warning indications.

* * * * *